United States Patent [19]

Bainbridge et al.

[11] Patent Number: 4,458,179

[45] Date of Patent: Jul. 3, 1984

[54] CONTROLLER FOR LAMP HAVING MORE THAN ONE LIGHT SOURCE

[75] Inventors: Richard C. Bainbridge; Richard G. Confer; Carl C. Krihwan; William R. Miller, all of Erie, Pa.

[73] Assignee: American Sterilizer Company, Erie, Pa.

[21] Appl. No.: 362,117

[22] Filed: Mar. 26, 1982

[51] Int. Cl.[3] ..... H05B 39/10

[52] U.S. Cl. ..... 315/88; 315/65; 315/291; 315/313; 362/804

[58] Field of Search ..... 315/65, 88, 291, 313, 315/175; 128/395, 396; 362/804, 254

[56] References Cited

U.S. PATENT DOCUMENTS

| | | | |
|---|---|---|---|
| 1,459,283 | 6/1923 | Das | 315/175 |
| 3,697,802 | 10/1972 | Demas | 315/65 |
| 3,814,947 | 6/1974 | Friedman | 315/88 |
| 4,034,259 | 7/1977 | Schoch | 315/88 |
| 4,349,863 | 9/1982 | Peterson | 362/254 |

FOREIGN PATENT DOCUMENTS 2914441 10/1980 Fed. Rep. of Germany .

*Primary Examiner*—Harold Dixon

*Attorney, Agent, or Firm*—Robert D. Yeager; Andrew J. Cornelius

[57] ABSTRACT

A controller for controlling operation of a multi-filament lamp is provided that permits selection of the filament to be energized from a control box placed at a remote location from the lamp. Only two leads are required to electrically connect the control box to the lamp. The controller automatically switches energizing power from a burned out filament to an alternate filament. The controller can also include a source of alternate power for the controller in the event that primary power is lost. The controller can also include a lock out feature which prevents switching energizing power at the control box from an energized filament to a failed filament.

3 Claims, 4 Drawing Figures

CONTROLLER FOR LAMP HAVING MORE THAN ONE LIGHT SOURCE

1. Field of the Invention

The present invention relates to controllers for lamps and, in particular, a controller for a lamp having more than one light source that permits control of the lamp from a location remote from the lamp.

2. Description of the Prior Art

Lamps having more than one light source are known generally and are useful during the performance of surgical procedures. Such lamps provide a readily available source of light upon failure of one of the light sources of the lamp. For example, the lamp disclosed in U.S. Patent Application Ser. No. 936,240 filed Aug. 24, 1978, discloses a lamp having multiple filaments, each of which provides light having a pattern different from those provided by the remaining sources.

Although lamps having more than one light source are more useful during performance of surgical procedures than are lamps with a single light source, several problems are associated with their use. First, the selection of which light source is energized must be made at the lamp head. Further, the switch to an alternate light source upon failure of an energized light source must be accomplished manually which causes a temporary loss of light.

SUMMARY OF THE INVENTION

The present invention provides a controller for a lamp having more than one light source that permits selection of which light source is energized at a location that is remote from the lamp head. Accordingly, personnel performing surgical procedures need not effect light source selection at the lamp head. Further, the present invention senses failure of a light source and automatically switches energizing current to an alternate light source. The apparatus of the present invention which is separated spatially from the lamp head is connected electrically to the lamp head with only two leads. Accordingly, the present invention can be installed easily in existing lamps which receive electrical power through only two leads. New lamps manufactured with the present invention installed are less complicated mechanically and less expensive than lamps which require three or more leads connected between the lamp head and the remotely located control apparatus.

The controller of the present invention includes apparatus separated spatially from the lamp for receiving electrical power from a primary source of electrical power and impressing across two leads which communicate electrically with the lamp an electrical potential capable of producing in the leads an electrical current suitable for energizing the light sources. The receiving apparatus includes apparatus for reversing the direction of flow of the energizing current by reversing the polarity of the electric potential. The controller also includes apparatus located at the lamp for permitting energizing current to flow through a light source, which light source is energized depending on the direction of flow of the energizing current. The controller also includes apparatus separated spatially from the lamp for automatically reversing the polarity of the electric potential upon failure of the light source that is energized by the energizing current.

The receiving apparatus can include apparatus for preventing the reversing apparatus from effecting a reversal of the polarity of the electric potential that would energize a failed light source. Further, the controller can include an alternate source of electrical power suitable for energizing the light sources and apparatus for supplying power from the alternate source to the controller upon failure of the primary source. Also, the controller can include apparatus separated spatially from the lamp for varying the intensity of the light produced by the light sources.

Preferably, the elements of the invention that are separated spatially from the lamp are located in a control box mounted at a convenient location. Reversal of the polarity of the electric potential can be accomplished by a bridgeconfigured switching apparatus comprising four switching devices. The polarity of the impressed voltage depends on which set of two switching devices is conducting. The apparatus for permitting energizing current to flow through one light source is, preferably, a diode.

When used herein, the terms "light source" and "filament" shall include elements through which electrical current flows to cause the elements to emit light.

BRIEF DESCRIPTION OF THE DRAWINGS

The following detailed description of the preferred embodiments can be understood better if reference is made to the attached drawings in which.

DETAILED DESCRIPTION OF THE PREFERRED EMBODIMENTS

Figure 1:
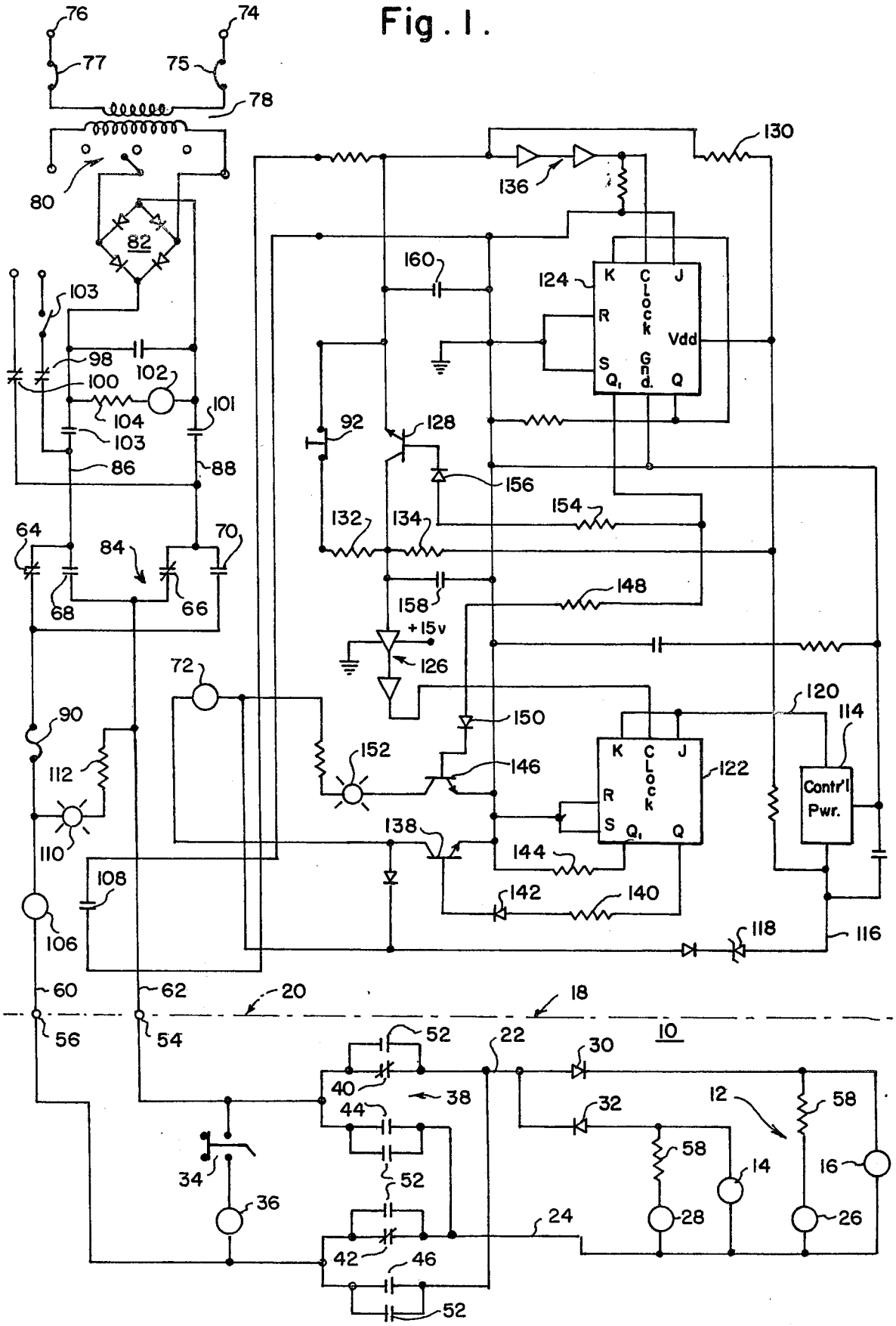
FIG. 1 is a circuit diagram showing the preferred embodiment of the present invention.

FIG. 1 is a circuit diagram showing the preferred embodiment of the present invention.

Controller 10 controls operation of lamp 12. Lamp 12 is a dual filament lamp having filaments 14 and 16. Lamp 12 is secured within a suitable light head 18. Components of controller 10 are located in light head 18 and control box 20. Control box 20 is mounted at any location which is convenient for operation of lamp 12.

The polarity of the voltage applied to lines 22 and 24 determine which filament 14 or 16 is energized. If line 22 is positive with respect to line 24, filament 16, along with indicator light 26, will be energized. Conversely, if line 24 is positive with respect to line 22, filament 14 along with indicator light 28 will be energized. Accordingly, switching the polarity of the voltage applied to lines 22 and 24 will cause one filament 14 or 16 to be extinguished and the remaining filament 14 or 16 to be energized. Diode 30 permits filament 16 and indicator light 26 to be energized only when line 22 is positive with respect to line 24. Diode 32 permits filament 14 and indicator light 28 to be energized only when line 24 is positive with respect to line 22.

A normally open contact switch 34 is located within light head 18 and is placed electrically in series with relay coil 36. Switch 34 and coil 36 are energized by the filament energizing power supplied to light head 18 by control box 20. Filaments 14 and 16 and indicator lights 26 and 28 are energized by power supplied by control box 20 through switching bank 38. Switching bank 38 includes a normally closed contact 40 connected in line 22, a normally closed contact 42 connected in line 24, a normally open contact 44 connected between lines 22 and 24 and a normally open contact 46 connected between lines 24 and 22, all of which are operated by relay coil 36. Contacts 40 and 42 are open and contacts 44 and 46 are closed when coil 36 is energized. A nonpolarized capacitor 52 is connected in parallel with each contact operated by coil 36 to reduce arcing across the contacts as they switch. Contacts 40 and 42 operate together to energize a filament 14 or 16 and contacts 44 and 46 operate together to energize a filament 14 or 16. Which filament 14 or 16 is energized by a pair of contacts 40 and 42 or 44 and 46 is determined by the polarity of the voltage applied to light head input terminals 54 and 56. If point 54 is positive with respect to point 56, closure of contacts 40 and 42 will cause filament 16 and indicator light 26 to be energized through diode 30 and closure of contacts 44 and 46 will cause filament 14 and indicator light 28 to be energized through diode 32. If point 56 is positive with respect to point 54, closure of contacts 40 and 42 will energize filament 14 and indicator light 28 through diode 32 and closure of contacts 44 and 46 will energize filament 16 and indicator light 26 through diode 30. The position of switch 34 determines which pair of contacts 40 and 42 or 44 and 46 are closed. If switch 34 is in its open position, contacts 44 and 46 are open and contacts 40 and 42 are closed. If switch 34 is in its closed position, contacts 40 and 42 are open and contacts 44 and 46 are closed. Given that the polarity of the voltage applied across points 54 and 56 remains constant, changing the position of switch 34 will open its contacts which were previously closed and close its contacts which were previously open, and deenergize the previously energized light and energize the previously de-energized light. A resistor 58 is connected if necessary in series with each indicator light 26 and 28 to reduce the voltage applied to those lights to their rated voltage.

Power to energize lamp 12 is supplied to light head 18 from control box 20 through lines 60 and 62. The polarity of the voltage applied to lines 60 and 62 depends on which pair of contacts 64 and 66 or 68 and 70 operated by relay coil 72 is conducting. Control box 20 receives power from a 115 volt AC source at points 74 and 76. Transformer 78 receives the input power through circuit breakers 75 and 77 and provides five voltages each having a level suitable for energizing lamp 12. Switch 80 is connected to the output of transformer 78 and is used to select the level of the voltage to be applied to lamp 12. The intensity of the light emitted from lamp 12 increases as the level of the voltage applied to it is increased. Bridge 82 receives voltage from transformer 78 through switch 80 and converts it to appropriate direct current voltage level. The output of bridge 82 is supplied to switching bank 84 along lines 86 and 88. Switching bank 84 is composed of normally closed contacts 64 and 66 and normally open contacts 68 and 70, all of which are operated by relay coil 72. Contact 64 is connected between lines 86 and 60, contact 66 is connected between lines 88 and 62, contact 68 is connected between line 86 and line 62, and contact 70 is connected between line 88 and line 60. When contacts 64 and 66 are closed, they impress a voltage across lines 60 and 62 that causes line 60 to be positive with respect to line 62. When contacts 68 and 70 are closed, they impress a voltage across lines 60 and 62 that causes line 60 to be negative with respect to line 62. Fuse 90 is connected in line 60 to protect circuit 10 against any excessively high current flowing in line 60. Given that the position of switch 34 is not changed, changing the conduction states of contacts 64, 66, 68 and 70 will effect a reversal of the polarity of the voltage impressed across lines 60 and 62, points 54 and 56, and lines 22 and 24, and cause the previously energized filament 14 or 16 to be de-energized and the previously de-energized filament 14 or 16 to be energized. As described more fully below, switch 92 is used to energize and de-energize relay 72 and, therefore, change which filament 14 or 16 is energized.

Alternate power is supplied from a source (not shown) to lines 86 and 88 through normally closed contacts 98 and 100, which are operated by relay coil 102. Relay coil 102 is connected between lines 86 and 88 and is energized unless the output from bridge 82 is lost. If the output of bridge 82 is lost, coil 102 is de-energized and normally closed contacts 98 and 100 close to supply alternate power to control box 20. Resistor 104 is connected in series with coil 102 to reduce the voltage impressed across coil 102 to its rated voltage. A switch 103 is provided to permit isolation of the alternate source from control box 20.

Coil 106 is connected in line 60 and operates a normally open contact 108. When an energized filament 14 or 16 fails, relay coil 106 is de-energized and contacts 108 open to cause energizing power to be switched from the failed filament 14 or 6 to the remaining filament 14 or 16, as is more fully described below. A pilot light 110 is connected across lines 60 and 62 to provide an indication whether power is available to control box output leads 60 and 62. Resistor 112 is connected in series with light 110 to insure that rated voltage is applied to light 110.

Power supply 114 receives system power along line 116 through Zener diode 118 and produces 15 volts DC on line 120. Flip flop 122 is so connected that its outputs switch states each time a clock pulse is applied to its clock terminal. Flip flop 124 is so connected that the first clock pulse it receives at its clock terminal after power is applied to circuit 10 causes its outputs to change states; any further clock pulses applied subsequently to the clock terminal of flip flop 124 have no effect on it. The J and K terminals of flip flop 122 are connected to the 15 volt output of power supply 114 and the R and S terminals of flip flop 122 are connected to ground. The clock terminal of flip flop 122 is connected to the 15 volt output of power supply 114 through a Schmitt trigger 126, transistor 128, and resistor 130. Also, filament select switch 92 and resistor 132 are connected across transistor 128. Resistor 134 is connected between the collector of transistor 128, resistor 132 and the input of Schmitt trigger 126 and the output of power supply 114. Resistors 132 and 134 constitute a voltage divider which creates at the input of Schmitt trigger 126 a voltage of a level just below that required to trigger Schmitt trigger 126. When transistor 128 is cut off and switch 92 is momentarily opened, the input to Schmitt trigger 126 rises to a level sufficient to trigger Schmitt trigger 126 and cause it to apply a clock pulse to the clock terminal of flip flop 122, thereby causing its outputs to change states.

The J, S, and R terminals of flip flop 124 are connected to ground and the clock terminal is connected to the 15 volt output of power supply 114 through Schmitt trigger 136 connected together. When power is first applied to circuit 10, the Q terminal of flip flop 124 is in its high state and the Q' terminal is in its low state. When relay contacts 108 are closed, the 15 volt input to the clock terminal of flip flop 124 is, essentially, connected to ground and cannot cause the outputs of flip flop 124 to change their state. When relay contacts 108 are opened, the 15 volt signal is removed from ground and applied to Schmitt trigger 136 which applies a clock pulse to the clock terminal of flip flop 124, thereby causing its outputs to change their state. Further application of clock pulses to the clock terminal of flip flop 124 have no effect on it until power is removed from circuit 10 and subsequently reapplied to it.

The output of flip flop 122 at terminal Q is applied to the base of transistor 138 through resistor 140 and diode 142. The output of flip flop 122 at terminal Q' is applied to the emitter of transistor 138 through a resistor 144. When terminals Q and Q' of flip flop 122 are in their high and low states, respectively, transistor 138 is saturated and coil 72 is energized. When terminals Q and Q' of flip flop 122 are in their low and high states, respectively, transistor 138 is cut off and relay coil 72 is de-energized. Accordingly, by applying successive clock pulses to flip flop 122, relay coil 72 can be energized and de-energized repeatedly.

The output of flip flop 124 at terminal Q' is connected to the base of transistor 146 through resistor 148 and diode 150. A filament failure light 152 is connected between the collector of transistor 146 and the positive output of bridge 82. When terminal Q' of flip flop 124 is in its high state, transistor 146 is saturated and lamp 152 is energized. Further, output terminal Q' of flip flop 124 is connected to the base of transistor 128 through resistor 154 and diode 156. When terminal Q' of flip flop 124 is in its high state, transistor 128 is saturated and prevents operation of switch 92 from causing Schmitt trigger 126 to apply a clock pulse to flip flop 122.

When power is first applied to circuit 10, relay coils 102 and 106 are energized, assuming the filament 14 or 16 to which power is applied has not failed. Accordingly, contacts 98 and 100 are open—isolating the alternate power source electrically from the remainder of circuit 10—and contact 108 is closed. Since contact 108 is closed, the 15 volt input to flip flop 124 is connected to ground and cannot trigger Schmitt trigger 136. Further, the emitter of transistor 128 is, essentially, connected to ground and the voltage impressed across transistor 128 is insufficient to trigger Schmitt trigger 126.

To change the filament 14 or 16 which is energized at control box 20, normally closed switch 92 must be operated—that is, opened—momentarily. When switch 92 is closed, the voltage divider formed by resistors 132 and 134 creates at the input to Schmitt trigger 126 a voltage insufficient to trigger it. When switch 92 is opened, resistor 132 is replaced in the voltage divider by cut off transistor 128 and the voltage at the input of the Schmitt trigger 126 rises to a level sufficient to trigger it and cause it to apply a clock pulse to flip flop 122 and cause its outputs to change their state. If terminal Q of flip flop 122 is changed to its high state, transistor 138 becomes saturated and relay coil 72 is energized. Contacts 64 and 66 open and contacts 68 and 70 close to make line 62 positive with respect to line 60. Assuming that switch 34 is in its open position, relay coil 36 is de-energized and filament 16 and light 26 are energized through diode 30. If the Q terminal is placed in its low state when flip flop 122 is clocked, transistor 138 is cut off and relay coil 72 is de-energized. Contacts 64 and 66 are closed and contacts 68 and 70 are open causing line 60 to be positive with respect to line 62. Assuming that switch 34 is in its open position, filament 14 and lamp 28 are energized through contacts 40 and 42.

The filament 14 or 16 which is energized by circuit 10 can be changed at the light head 18 by operating switch 34. Assuming that switch 34 is in its open position and point 56 is positive with respect to point 54, filament 14 and indicator light 28 are energized through diode 32. Closing switch 34 causes relay coil 36 to be energized, contacts 40 and 42 to be opened, and contacts 44 and 46 to be closed. Accordingly, lamp 16 and indicator light 26 are energized through diode 30. Reopening switch 34 opens contacts 44 and 46 and closes contacts 40 and 42 causing filament 14 and light 28 to be energized through diode 32.

When neither filament 14 nor 16 is failed, relay coil 106 is energized and contact 108 is closed. The 15 volt input to flip flop 124 and the emitter of transistor 128 are, essentially, connected to ground and neither Schmitt triggers 126 nor 136 can apply a clock pulse to flip flops 122 or 124. When an energized filament 14 or 16 fails, relay coil 106 is deenergized and contacts 108 open. The voltage at the input to Schmitt trigger 126 rises to a level sufficient to trigger it and it applies a clock pulse to flip flop 122 which, as described above, either energizes or de-energizes relay coil 72, reversing the polarity of the signal on lines 60 and 62 and changing the filament 14 or 16 which is energized. After a time delay that is sufficient to enable flip flop 122 to energize the remaining filament and de-energize the failed filament, the 15 volt input to Schmitt trigger 136 is applied to it and it applies a clock pulse to flip flop 124. Output terminal Q' of flip flop 124 changes its state to high and saturates transistor 146 causing failure lamp 152 to be lit. Also, transistor 128 is saturated by the output of flip 20 flop 124 at terminal Q' rendering operation of switch 92 ineffective; thus, it is not possible to cause circuit 10 to attempt to energize a failed filament unless power is first removed from circuit 10. A capacitor 158 is connected between the input to Schmitt trigger 126 and ground and a capacitor 160 is connected between the emitter of transistor 128 and ground to provide a time delay between the voltage rises which are capable of triggering Schmitt triggers 126 and 136 and the time when they are actually triggered. The sizes of resistors 130 and 134 and capacitors 158 and 160 must be chosen to insure that flip flop 124 is not clocked upon filament failure until flip flop 122 has been clocked once to switch energizing power from the failed to the remaining filament 14 or 16. It is preferred that the product of the values of resistors 134 and capacitor 158 be no more than one tenth the product of resistor 30 and capacator 160.

Alternate power is applied to circuit 10 when the output from bridge 82 is lost and relay coil 102 is de-energized. Contacts 98 and 100 close permitting alternate power to be applied to switching bank 84. Further, when relay coil 102 is de-energized, contacts 101 and 103 open to isolate the remainder of circuit 10 from the output of bridge 82.

Figure 2:
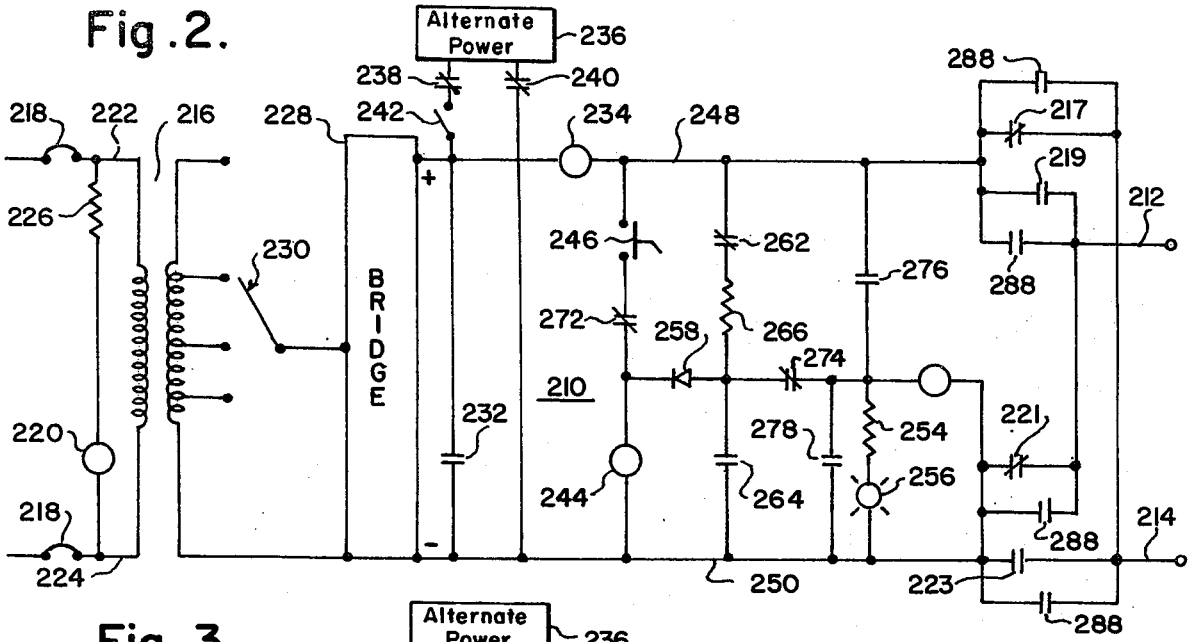
FIG. 2 is a circuit diagram showing an alternate control box circuit which uses electromagnetic relays in place of solid state switching devices.

FIG. 2 shows a circuit 210 that can replace the portion of circuit 10 that is located within control box 20 and that includes magnetic relays rather than solid state switching devices Circuit 210 provides power to energize a filament 14 or 16 on lines 212 and 214. As with circuit 10, energizing power can be switched from one filament 14 or 16 to another by changing the polarity of the voltage applied to lines 212 and 214 by changing the state of conduction of contacts 217, 219, 221 and 223. Input AC voltage is applied to transformer 216 through circuit breakers 218. Relay coil 220 is connected between leads 222 and 224 and is energized when power is supplied to transformer 216. If 220 volt power is applied to transformer 216, a resistor 226 is placed in series with relay coil 220 to reduce the voltage applied to coil 220 to 110 volts. A voltage having one of five levels can be selected for application to bridge 228 using switch 230, which is connected between the output of transformer 216 and the input of bridge 228. Bridge 228 rectifies the sinusoidal output of transformer 216. A relay coil 234 is connected to the positive output of bridge 228. A capacitor 232 is connected across the output of bridge 228 to prevent the chattering of the reed of relay coil 234 that would occur if raw full wave rectified direct current were supplied to it by bridge 228. Also, capacitor 232 boosts the RMS value of the direct current supplied to lamp 12 to provide rated voltage to it. An alternate power supply 236 is connected across the output of bridge 228 to provide power to the remainder of circuit 210 if input power to transfomer 216 is lost. Contacts 238 and 240 are normally closed and are opened when input power is available to transformer 216. When input power is lost, relay coil 220 is de-energized and contacts 238 and 240 close to supply power to the remainder of circuit 210. Switch 242 is provided to allow alternate power supply 236 to be isolated from the remainder of circuit 210.

Relay coil 244, normally closed contact 272 of relay coil 270, and normally open push button switch 246 are connected in series between lines 248 and 250. Capacitor 264, resistor 266, and normally closed contact 262 of relay coil 234 are also connected in series between lines 248 and 250. A diode 258 is connected at a point between contacts 272 and relay coil 244 and a point between resistor 266 and capacitor 264. A failure indicator lamp 256, resistor 254, and normally open contact 276 of relay coil 270 are connected in series between lines 248 and 250. A capacitor 278 is connected across resistor 254 and failure lamp 256. Normally closed contact 274 of relay coil 270 is connected at a point between resistor 266 and capacitor 264 and a point between contacts 276 and resistor 254. Relay coil 270 is also connected across resistor 254 and 256.

Contacts 217 of relay coil 244 are connected between line 248 and line 214. Contacts 219 of relay coil 244 are connected between lines 248 and 212. Contacts 223 of relay coil 244 are connected between lines 250 and 214. Contacts 221 are connected between lines 250 and 212. Contacts 217 and 221 close together when relay coil 244 is de-energized to impress across lines 212 and 214 a voltage that makes line 214 positive with respect to 212. Contacts 219 and 223 are closed together by relay coil 244 to impress a voltage across lines 212 and 214 that makes line 212 positive with respect to line 214. Changing the polarity of the voltage impressed across lines 212 and 214 by energizing or de-energizing relay coil 244 causes the lit filament 14 or 16 to be de-energized and the remaining filament 14 or 16 to become energized.

To operate circuit 210, 110 or 220 volts AC is applied to transformer 216 and switch 230 is placed in one of the five positions shown in FIG. 2. Increasing the voltage applied to bridge 228 will increase the intensity of the light emitted by an energized filament 14 or 16. Depending on the position of switch 34 in lamp head 18, filament 14 or 16 will be energized through line 212 and relay coil 234 will be energized. With relay coil 234 energized, normally closed contacts 262 are open and relay coil 270 cannot be energized. Upon failure of an energized filament 14 or 16, relay coil 234 is de-energized and contacts 262 close to energize relay coil 270. Energizing coil 270 causes contacts 272 and 274 to open and contacts 276 to close. Closing of contacts 276 insures that relay coil 270 will be energized until power is removed from transformer 216. The closing of contacts 262 also causes relay coil 244 to be energized through diode 258. Energizing relay coil 244 causes its contacts 217, 219, 221 and 223 to change states and switch power from the failed to the remaining filament 14 or 16. The opening of contacts 272 renders ineffective further operation of switch 246 and insures that circuit 210 will not attempt to energize the failed filament unless power is first removed from transformer 216. Closure of contacts 276 energizes failure lamp 256 through resistor 254 and insures that relay coil 270 will be energized until power is removed from circuit 210. Relay coils 234 and 270 should be so chosen that, upon filament failure, coil 234 does not open contact 262 until energizing power is switched by relay coil 270 to the remaining filament 14 or 16.

Absent a condition where one filament has failed, energizing power can be switched from one to the remaining filament 14 or 16 by momentarily depressing normally open push button 246. Depressing switch 246 causes relay coil 244 to be energized through contacts 272. Energizing relay coil 244 causes contacts 217, 219, 221 and 223 to reverse their states and de-energize the lit and energize the remaining filament 14

A capacitor 288 is connected across each contact 217, 219, 221 and 223 to reduce arcing across those contacts upon switching. Capacitor 278 provides a pulse to relay coil 270 upon failure of a filament 14 or 16 to insure that complete closure of contacts 276 is effected. Capacitor 264 prevents relay coils 244 and 270 from being energized when power is first applied to circuit 210. Diode 258 prevents relay coil 270 from being energized when switch 246 is depressed.

Figure 3:
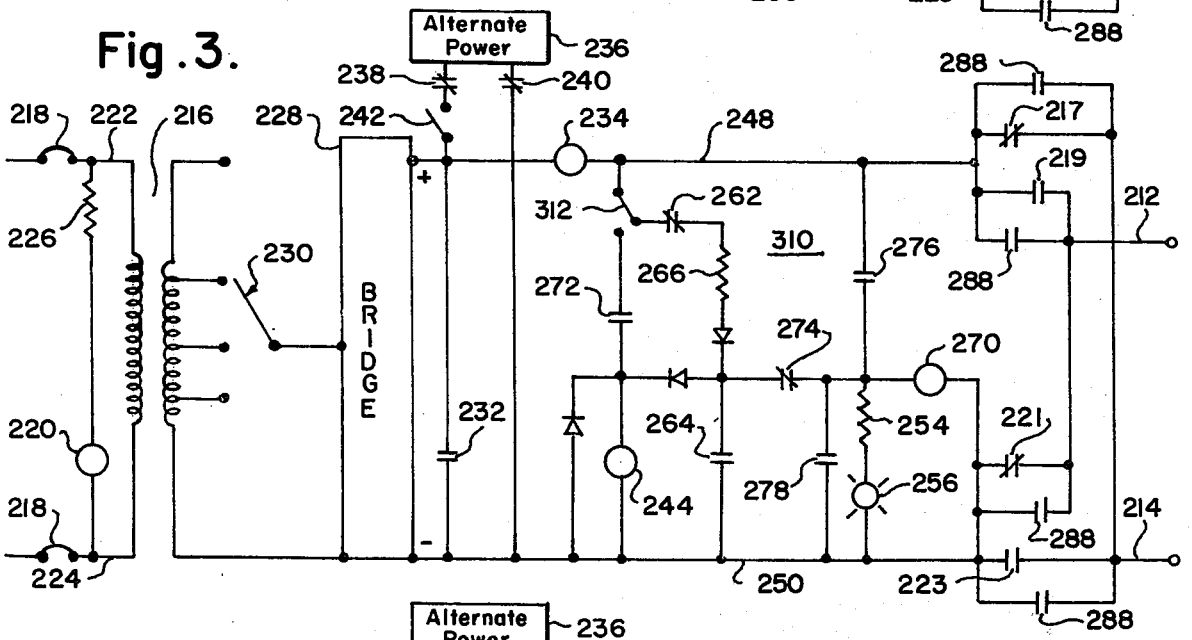
FIG. 3 is an alternate control box circuit that is similar to the circuit shown in FIG. 2.

FIG. 3 shows a circuit 310 which is similar to circuit 210 except that switch 246 of circuit 210 is replaced by switch 312 in circuit 310. Contact 262 has been removed from line 248 and connected to switch 312. This allows recovery from a condition in which an inoperational filament is selected when power is first applied. Otherwise, operation of circuit 310 is identical to that of 210.

Figure 4:
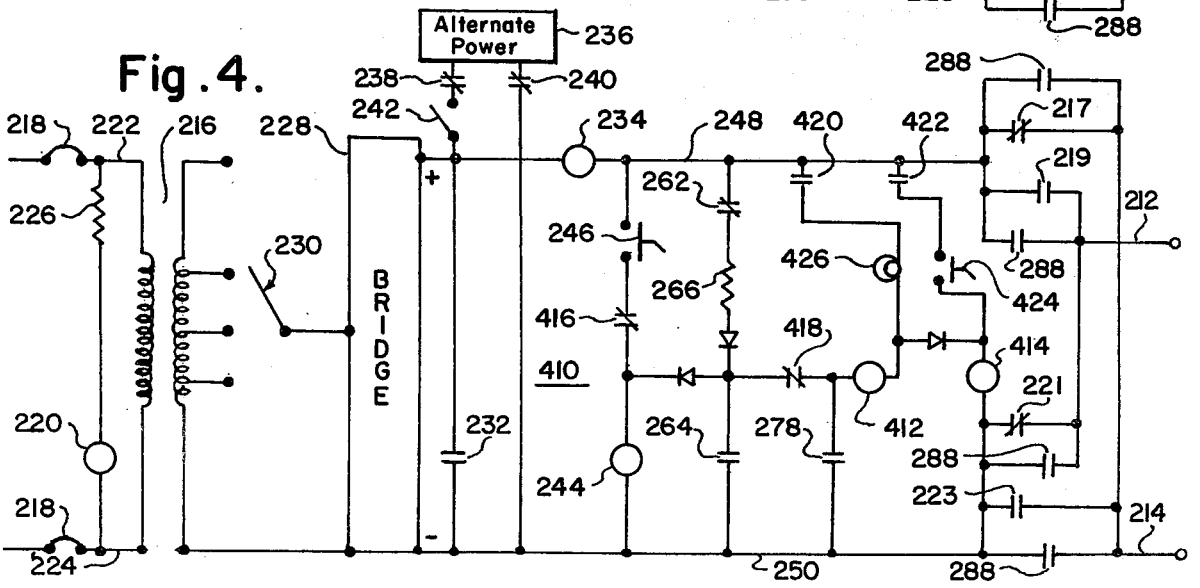
FIG. 4 is another alternate control box circuit that is similar to the circuit shown in FIG. 2.

FIG. 4 shows a circuit 410 which is identical to circuit 210 except that relay coil 270 is replaced by a latching relay. When energized, relay coil 412 of the latching relay causes contacts 416 and 418 to open and causes contacts 420 and 422 to close. Energizing reset coil 414 causes contacts 416 and 418 to close and contacts 420 and 422 to open. Energizing coil 412 when contacts 416 and 418 are open and contacts 420 and 422 are closed has no effect. Accordingly, when power is removed from transformer 216 subsequent to a filament failure and then reapplied to transformer 216, contacts 416 remain open and switch 246 cannot be operated to energize relay coil 244 to switch energizing power to the burned out filament. After the burned out filament has been replaced, reset push button 424 can be depressed to energize reset coil 414 through contacts 422 to close contacts 416 and 418 and open contacts 420 and 422 and permit coil 244 to be energized by operation of switch 246. An indicator lamp 426 is connected in series with contacts 420 to provide an indication that switch 246 is not operational. When reset button 424 is depressed, relay coil 414 is energized and contacts 420 open to de-energize lamp 426 and relay coil 412 to indicate that switch 246 is operational.

What is claimed is:

1. A controller for a lamp having more than one light source comprising:

a control box adapted for placement at a location that is remote from the lamp;

means disposed in said control box for reducing the level of the alternating voltage supplied to said controller to at least one level suitable for energizing the light sources;

means for converting said reduced alternating voltage to a direct voltage having a substantially constant amplitude capable of producing an electrical current suitable for energizing the light sources;

bridge-configured switching means having switching devices which can conduct or block electrical current for impressing said direct voltage across two leads which communicate electrically with the lamp, the polarity of said impressed voltage depending upon which of said switching devices are conducting;

means for causing said switching means to reverse the polarity of said impressed voltage;

means for automatically causing said switching means to reverse the polarity of said impressed voltage upon failure of a light source to which said impressed voltage is applied; and means operatively connected to each light source for permitting current flow through said light source in only one direction, reversal of the polarity of said impressed voltage causing the direction of current flow through the lamp to be reversed and causing one light source to be extinguished and a second light source to be energized.

2. The controller recited in claim 1 further comprising a source of alternate electrical power suitable for energizing the light sources; and means for applying power from said alternate power source to said switching means upon failure of said supplied voltage.

3. A controller for a lamp having two sets of light sources, each set having at least one light source comprising:

means separated spatially from the lamp for receiving electrical power from a primary source of electrical power and impressing across two leads which communicate electrically with the lamp an electrical potential capable of producing in said leads an electrical current suitable for energizing the light sources, said receiving means including means for reversing the direction of flow of said energizing current by reversing the polarity of said electrical potential;

means located at the lamp for permitting energizing current to flow through one set of light sources, which set is energized by said permitting means depending on the direction of flow of said energizing current;

means separated spatially from the lamp for automatically reversing the polarity of said electrical potential upon failure of a light source that is energized by said energizing current;

means for preventing a reversal of the polarity of said electrical potential that represents an attempt to energize a failed light source;

an alternate source of electrical power suitable for energizing said light sources;

means for supplying power from said alternate source to said controller upon failure of said primary source; and means separated spatially from the lamp for varying the intensity of the light produced by the light sources.

* * * * *

UNITED STATES PATENT AND TRADEMARK OFFICE

CERTIFICATE OF CORRECTION

PATENT NO. : 4,458,179

DATED : July 3, 1984

INVENTOR(S) : Richard C. Bainbridge, et al.

It is certified that error appears in the above—identified patent and that said Letters Patent is hereby corrected as shown below:

Col. 2, line 16, delete "bridgeconfigured" and substitute therefor --bridge-configured--;

Col. 3, line 36, delete "deenergize" and substitute therefor --de-energize--;

Col. 4, line 31, delete "6" and substitute therefor --16--;

Col. 5, line 1, after "136" insert --and resistor 130. The K and Q terminals of flip flop 124 are--;

Col. 6, line 39, delete "20";

Col. 6, line 55, delete "30" and substitute therefor --130--;

Col. 6, line 67, after "devices" insert --.--; and

Col. 8, line 35, after "filament 14" insert --or 16.--.

Signed and Sealed this

*First* Day of *January 1985*

[SEAL]

*Attest:*

*Attesting Officer*

GERALD J. MOSSINGHOFF

*Commissioner of Patents and Trademarks*